US005613449A

United States Patent [19]

Pullman

[11] Patent Number: 5,613,449

[45] Date of Patent: Mar. 25, 1997

[54] ADJUSTABLE SHELVING SYSTEM

[75] Inventor: Richard G. Pullman, Middleboro, Mass.

[73] Assignee: J. Baker, Inc., Hyde Park, Mass.

[21] Appl. No.: 416,634

[22] Filed: Apr. 5, 1995

[51] Int. Cl.[6] ..... A47B 9/00

[52] U.S. Cl. ..... 108/108; 108/102; 211/90; 248/240

[58] Field of Search ..... 108/108, 137, 108/102, 110, 143; 211/90; 248/235, 240, 290.3, 250, 243, 241

[56] References Cited

U.S. PATENT DOCUMENTS

| | | | |
|---|---|---|---|
| 2,932,408 | 4/1960 | Jacobson . | |
| 3,447,489 | 6/1969 | Kagan . | |
| 3,469,543 | 9/1969 | Everett . | |
| 3,785,301 | 1/1974 | Lundqvist . | |
| 3,965,826 | 6/1976 | Markham | 108/108 X |
| 3,993,002 | 11/1976 | Storh | 108/102 X |
| 4,036,369 | 7/1977 | Eisenberg . | |
| 4,299,368 | 11/1981 | Winkler . | |
| 4,381,715 | 5/1983 | Forman . | |
| 4,669,692 | 6/1987 | Mastrodicasa . | |
| 5,104,080 | 4/1992 | Berger | 248/250 |
| 5,272,991 | 12/1993 | Carrigan, Jr. | 108/108 |
| 5,346,077 | 9/1994 | Randall | 248/243 X |
| 5,456,435 | 10/1995 | Sweeney | 248/250 |

FOREIGN PATENT DOCUMENTS

| | | | |
|---|---|---|---|
| 74309 | 3/1954 | Netherlands | 108/108 |
| 307587 | 6/1955 | Switzerland | 108/108 |
| 349384 | 11/1960 | Switzerland | 108/102 |

*Primary Examiner*—Jose V. Chen

*Attorney, Agent, or Firm*—Wolf,Greenfield & Sacks, P.C.

[57] ABSTRACT

An Adjustable shelving system wherein a shelf and bracket subassembly is mounted on standards secured to a vertical surface. The brackets are permanently secured to a shelf and each bracket slides along the length of the shelf to accommodate the spacing of the standards, and the brackets may be pivoted on the shelf between an operative and stored position.

26 Claims, 4 Drawing Sheets

ADJUSTABLE SHELVING SYSTEM

BACKGROUND OF INVENTION

This invention relates to adjustable shelving systems and more particularly comprises an improved system wherein one or more shelf brackets is permanently secured to the shelf and wherein the bracket or brackets may be slid along the shelf to accommodate the location of mounting standards to which the bracket or brackets is connected and further which enables the bracket or brackets to be moved between an operative position essentially perpendicular to the shelf and a stored position in a plane closely adjacent and parallel to the shelf.

For a very long time shelving systems have been available both for commercial and home use, which allow the shelves to be raised or lowered to best serve the intended functions of the shelves. The most common of these systems includes two standards which are secured to a wall and have a series of slots in their front faces, which receive a mounting fixture at the rear end of each shelf-supporting bracket. The shelves come in a variety of sizes and in many instances the mounting fixtures on the brackets enable the shelves to be supported either in a horizontal or an inclined plane depending upon the intended use.

In the basic system described, the brackets are not permanently attached to the shelves but rather are separate units which are attached to the standards independently of the shelves. Only after the brackets are mounted on the standards are the shelves placed on the brackets. Therefore, uniform spacing of the standards and mounting the standards in a precisely vertical orientation is not required. Each bracket is mounted independently of the others as well as independently of the shelves, and therefore complete flexibility is afforded the person assembling the system. A disadvantage of such systems, however, is that when the shelves and brackets are stored, they become separated from one another and the brackets are frequently misplaced.

In U.S. Pat. No. 3,469,543, an improved shelf construction is shown wherein the brackets are permanently secured to the shelf so that the brackets cannot be misplaced or lost. In accordance with the '543 patent, the brackets are in fixed positions at the ends of the shelf, and therefore require that the standards be precisely mounted a prescribed distance apart and in true vertical orientation so that the spacing between the adjacent standards is the same at the bottom and top. In the system of the '543 patent, unless the standards are mounted the prescribed distance apart and vertically true, the shelf cannot be mounted on the standards by means of the fixed brackets. A feature of the '543 shelf system is that the brackets which are permanently connected to the shelf at fixed locations may be pivoted between an erect or operative position, and a stored position wherein the brackets lie closely adjacent to and in a plane parallel to the plane of the shelf. When so stored, the shelves may be stacked in a compact column or be packaged in a container of minimum size.

In accordance with the present invention, the adjustable shelving system is improved by providing the brackets with the ability to move along the shelf so as to be connected to standards of any spacing but at the same time maintaining the permanent connection between the brackets and shelf. While the brackets are slidably movable along the length of the shelf, they may also be folded to a stored position wherein they lie in a plane closely adjacent and parallel to the plane of the shelf.

Other prior art patents known to applicant are U.S. Pat. Nos. 3,785,301; 4,036,369; and 4,381,715. The '301 patent shows an adjustable shelf structure having a rigid wire mounted at each end of the shelf. The wire, however, is not pivotable but rather is permanently disposed essentially in the plane of the shelf. The '369 patent is functionally similar to '301. The '715 patent shows a bracket support which includes a shaft threaded at its ends so that it may be screwed into a stud, and the support shafts slide in elongated chambers formed in the shelf. The support shafts are not pivotally secured to the shelf, but rather are held in place by spring clips and may be removed.

The principal object of the present invention is to provide an adjustable shelving system wherein the brackets are permanently secured to the shelf so that they cannot be lost or otherwise separated from the shelf but are free to slide along the shelf to accommodate different standard spacings, and which also are capable of being pivoted between an operative position wherein the brackets lie essentially perpendicular to the shelf and a stored position wherein the brackets lie in very close proximity to the shelf.

This invention will be better understood and appreciated from the following detailed description read with reference to the accompanying drawings.

DETAILED DESCRIPTION

Figure 1:
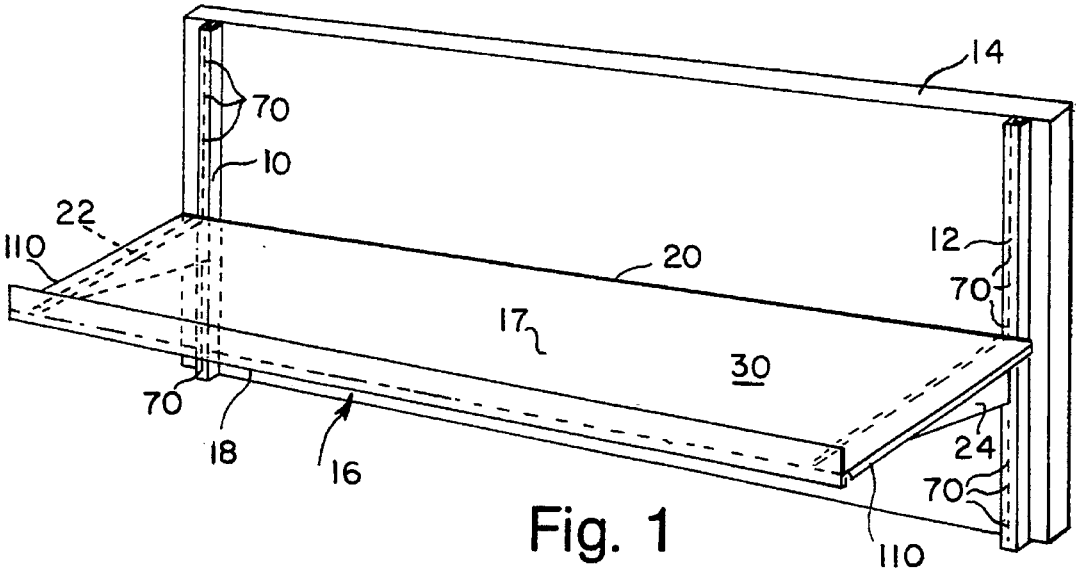
FIG. 1 is a perspective view of an adjustable shelving system embodying the present invention.
Figure 2:
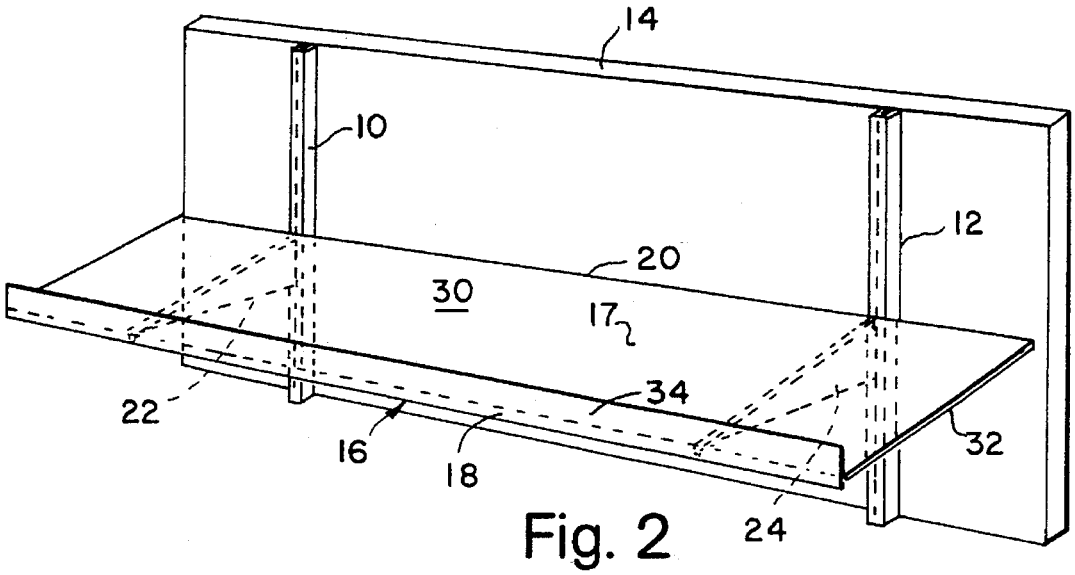
FIG. 2 is a perspective view similar to FIG. 1 but showing the shelving system adjusted to accommodate a different spacing of the standards than shown in FIG. 1.

In FIGS. 1 and 2 the adjustable shelving system shown includes a pair of standards 10 and 12 secured to a wall or other vertical support 14 and a shelf and bracket subassembly 16 that is supported on the standards 10 and 12. In FIG. 2 the standards 10 and 12 are spaced closer together than in FIG. 1, and the shelf and bracket subassembly 16 is nevertheless supported on the standards. The adjustability of the brackets in the subassembly enables the system to accommodate the different standard spacings.

In accordance with the present invention, the shelf and bracket subassembly is composed of a shelf 17 and two or more brackets 22 and 24. The shelf 17 typically may be made of sheet metal such as 22 gauge embossed steel and may be made in 24, 36 and 48 inch lengths. While not shown in the drawing, the shelf may have one or more longitudinally extending ribs intermediate the front and rear edges 18 and 20 of the shelf. The shelf may also be perforated over selected areas, and the steel may be textured as well. The shelf material and its particular design except for the parts described below do not constitute part of the present invention. The brackets 22 and 24 are permanently secured to the shelf but, as described below, are movable translationally along the length of the shelf 17 and are pivotable on the shelf between operative and stored positions.

The ability of the brackets 22 and 24 to move longitudinally along the shelf 17 toward and away from one another specifically accommodates different spacings of the standards 10 and 12 which support the shelf and bracket subassembly 16. Conventionally, particularly in industrial applications, the standards are mounted on a wall 24 inches apart but under certain conditions that spacing is either inconvenient or impossible to accommodate other requirements of the shelving system. Moreover, sometimes through error, the standards are not accurately positioned on the wall by the party installing them, and upon occasion the standards are not exactly parallel to one another so that the distance between adjacent standards at different elevations varies. The adjustability of the brackets with respect to the shelves to which they are attached accommodates these variations without sacrificing the benefits derived from having the brackets permanently attached to the shelves.

The shelf 17 shown has an upper surface 30 and a lower surface 32, and is provided with an upturned lip 34 along its front edge 18 to retain objects placed on the shelf. The lip 34 is particularly desirable when the shelf is mounted in other than a horizontal plane on the standards. As shown clearly in FIGS. 3, 4, 6 and 9, the lip 34 is formed by bending the sheet metal from which the shelf is made, upwardly from the front edge 18 to form a first panel 36 and then downwardly to form a longer front panel 38. The panel 38 extends below the bottom surface 32 of the shelf 17. The lower end 40 of the panel 38 is bent upwardly as shown in the drawings to define a track 42 in the form of a channel 46 between a rear flange 44 and the lower end 40 of the front panel 38. The open channel 46 receives a tab 48 formed as an integral part of the bracket 22, as is described more fully below.

The rear edge 20 of the shelf 17 carries a downwardly extending panel 50 that is bent upwardly at its bottom to form a track 52 comprising a channel 54 defined by the panel 50 and the upturned flange 56. The channel 54 is the mirror image of the channel 46 and it receives a tab 58 formed as an integral part of the bracket 22 at the rear end thereof.

Brackets 22 and 24 are mirror images of one another and only one need be described in detail. Bracket 22 is generally triangular in shape having a main body 60 and an upper flange 62 lying in mutually perpendicular planes. When in the operative position, the body 60 is oriented vertically. The length of the bracket measured between the tabs 48 and 58 is, of course, dictated by the depth of the shelf to which the bracket is attached. The shelves may typically be made in 10, 12 and 14 inch depths, in which case the brackets will be of corresponding lengths to accommodate the different shelf depths. The brackets may typically be made of 13 gauge steel but like the shelf, a wide variety of materials may be used.

Figure 3:
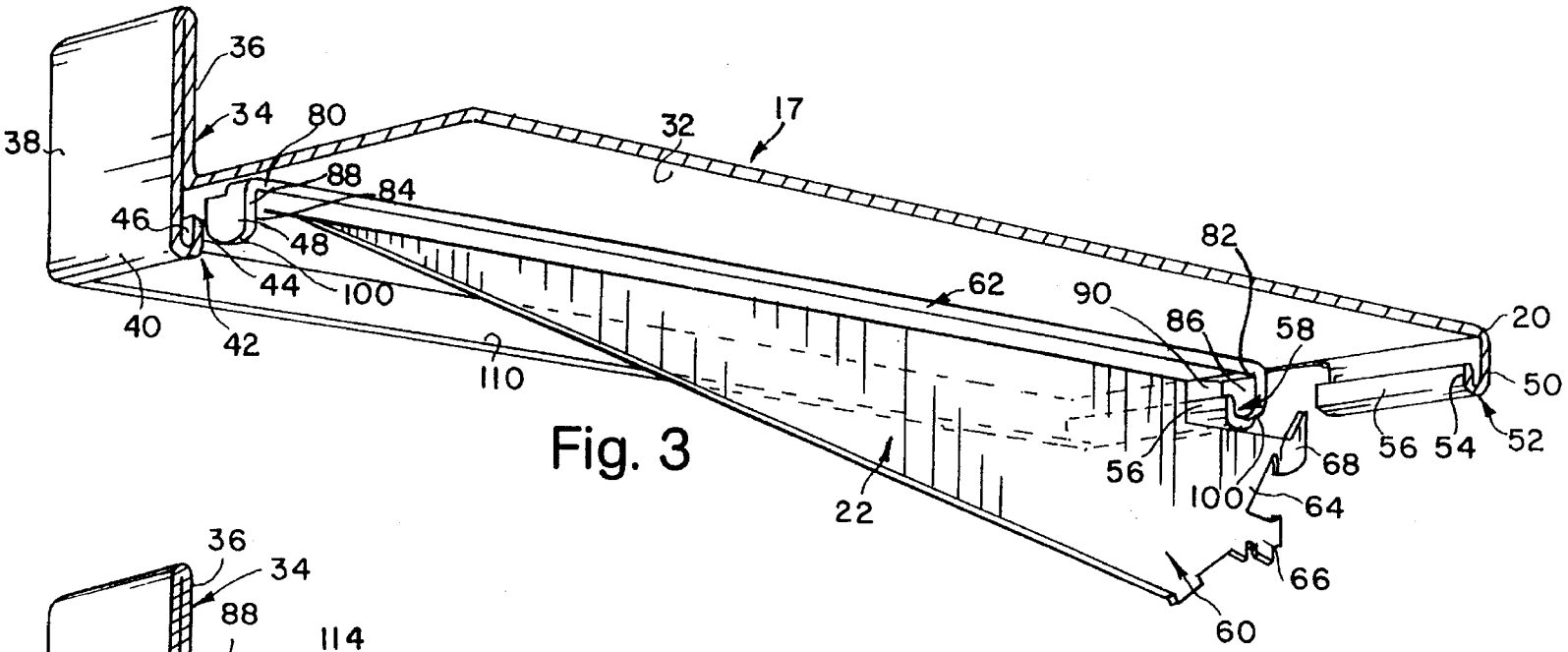
FIG. 3 is a fragmentary bottom perspective view of a shelf and bracket subassembly forming part of the system of FIG. 1 and illustrating the bracket in the shelf supporting position.
Figure 4:
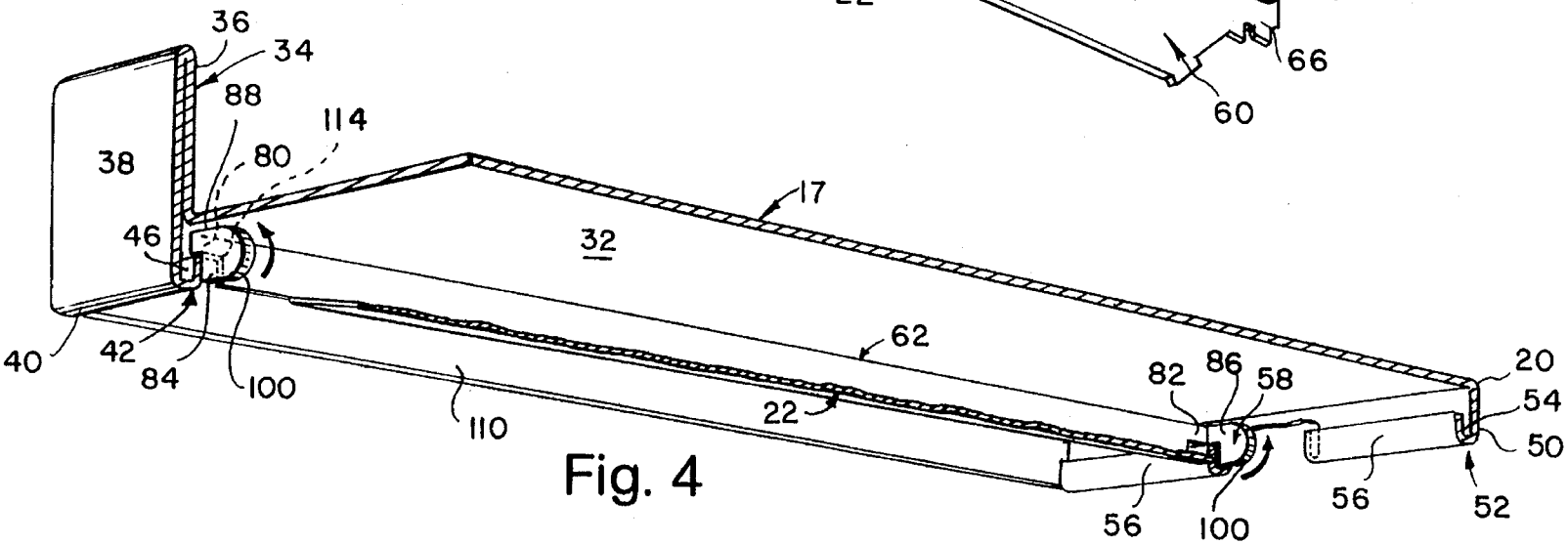
FIG. 4 is a fragmentary perspective view similar to FIG. 3 but showing the bracket in a collapsed or stored position.
Figure 5:
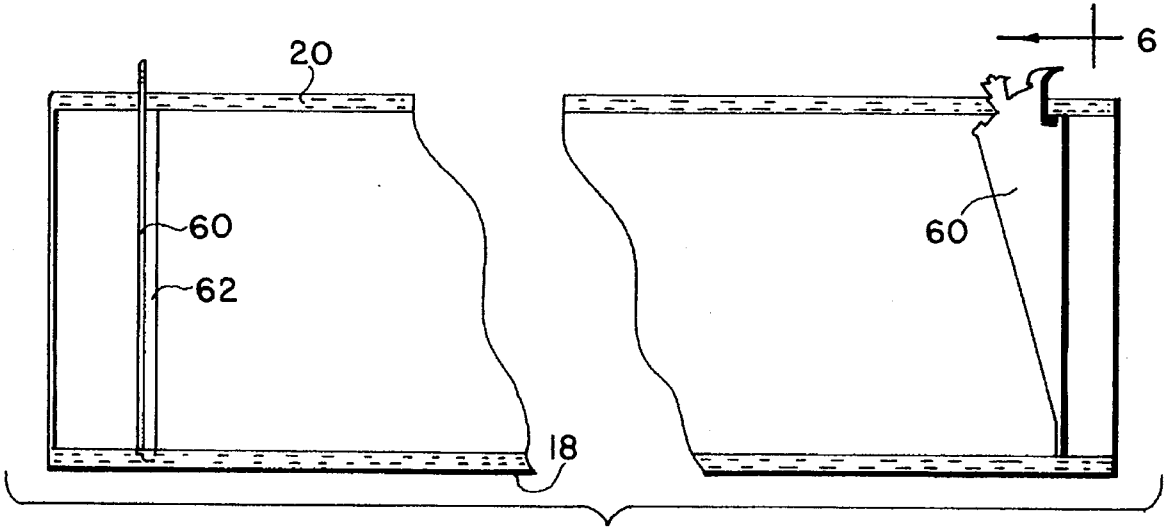
FIG. 5 is a bottom plane view of the shelf and brackets subassembly with the shelf partially broken away and with the left bracket in the operative position and the right bracket in the stored position.
Figure 9:
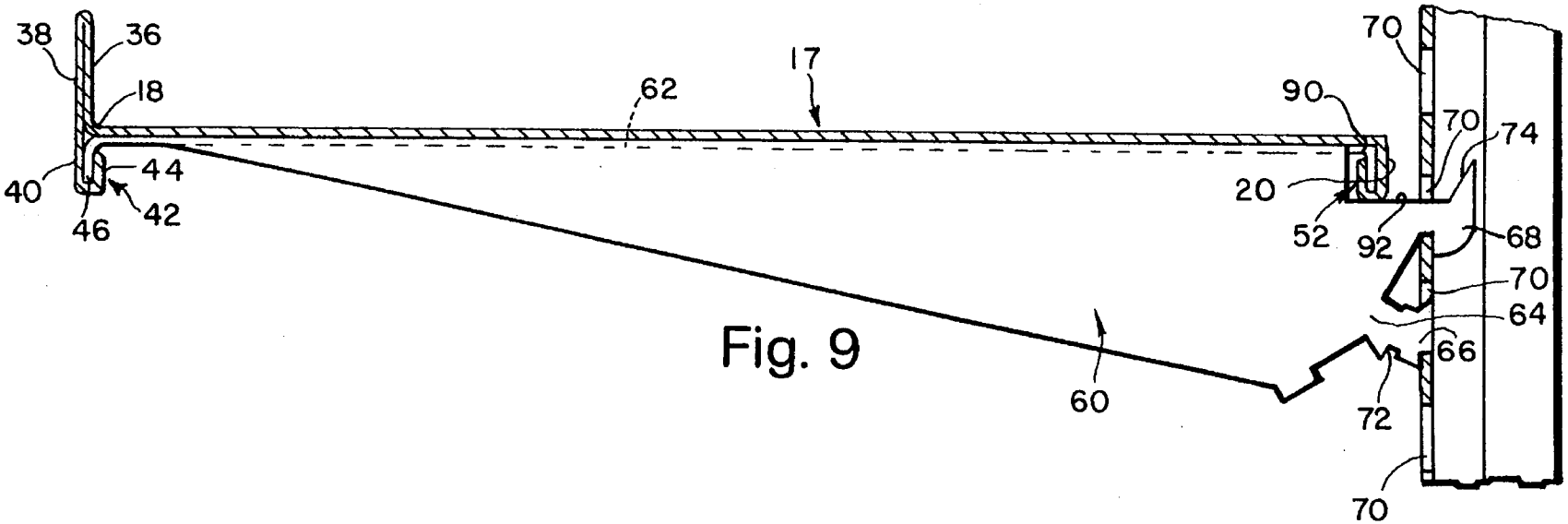
FIG. 9 is a cross-sectional view of the shelving system showing the manner in which the bracket engages a standard when in one of several alternative operative positions.

The bracket 22 shown in FIGS. 3 and 9, at its rear end 64, carries a pair of ears 66 and 68 which are designed to cooperate with the vertical slots 70 in the standard to support the bracket in operative position. A variety of different ear configurations have been developed and the particular ear configuration does not form part of the present invention. Preferably, however, the configuration of the ears is such that the bracket may be attached so that its upper flange 62 is oriented horizontally as in FIG. 9 and/or at an angle of perhaps 30 degrees to the horizontal by means of the notch 72 in the lower ear 66 and the angled edge 74 on the upper front side of the upper ear 68. To attach the brackets to the standards, the upper ear 68 is first inserted through one of the slots 70 with the front edge of the bracket elevated above the level of the slot so that the bracket is tipped upward, and after the upper ear is inserted in the selected slot the bracket is pivoted downwardly so as to allow lower ear 66 to enter and hook into the slot below the one that is occupied by the upper ear 68.

Figure 6:
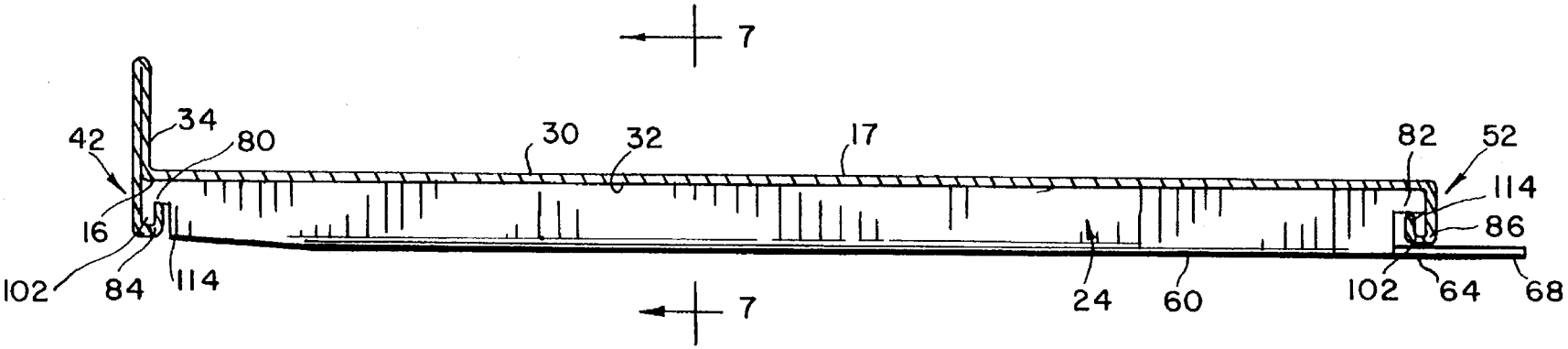
FIG. 6 is a cross-sectional view of the shelf and bracket subassembly taken along the section line 6—6 in FIG. 5 FIG.

As shown in FIGS. 3 and 6, the flange 62 of the bracket 22 has extensions 80 and 82 at its front and rear ends, respectively, and the extensions in turn are bent downwardly and respectively carry the tabs 48 and 58. The extensions 80 and 82 space the inner surfaces 84 and 86 of the tabs 48 and 58, respectively from the ends of the main portion of the horizontal flange 62 so as to accommodate the flanges 44 and 56 of the front and rear tracks 42 and 52. That spacing defines slots 88 and 90 at the front and rear ends of the bracket.

In FIGS. 3 and 9 the rear upper portion of the body 60 of the bracket is shown to have a step 92 which enables the bracket to extend under the track 52 at the rear edge 20 of the shelf 17. That step functions only when the bracket is in the operative position with body 60 perpendicular to the plane of the shelf 17. As is evident in FIG. 6, the flange 62 drops the body 60 beneath the lower edge of the track 52 when the bracket is in the stored position with the body 60 parallel to the plane of the shelf 17.

The tabs 48 and 58 have arcuate lower edges 100 in the shape of semicircles. The shape of those surfaces enables the bracket to slide rather freely in the tracks 42 and 52 so that the position of the bracket may be readily adjusted by the party installing the shelf bracket subassembly on the standards. The semicircular surfaces 100 also reduce the resistance encountered when the brackets are pivoted between the operative and stored positions. The height of the tabs as shown in FIG. 8 does, however, serve to releasably hold the bracket in the operative position as the bottoms of the tabs ride on the bottoms of the tracks and the tops of the tabs are very close to the lower surface 32 of the shelf 17. The width of the tabs 48 and 58 measured between their parallel side edges 102 and 104 is sufficient to frictionally retain the brackets in the stored position as shown in FIG. 7.

The brackets 22 and 24 are retained in the track 42 and 52 by the end flanges 110 formed at the ends of the shelf 17. The flanges 110 will engage either the flange 62 or body 60 of a bracket when the bracket is slid to either end of the shelf 17 and prohibit the tabs 48 and 58 from sliding out of the tracks. Thus, the brackets 22 and 24 are permanently retained on the shelf although they may move freely along the length thereof and pivot between operative and inoperative or stored positions.

Figure 7A:
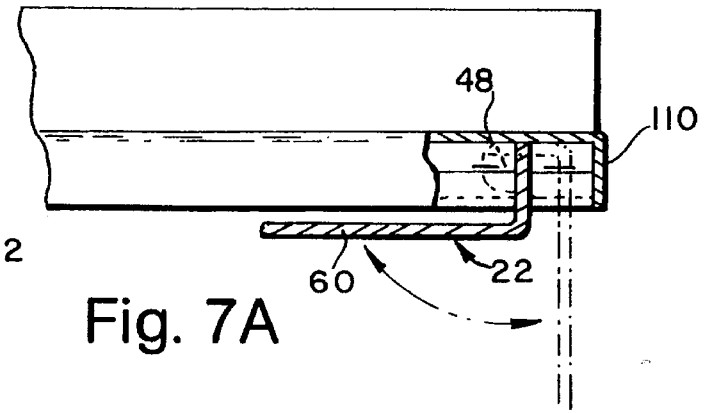
FIG. 7A is a cross-sectional view similar to FIG. 7 but taken through the other bracket and further showing the two positions of the bracket.
Figure 7:
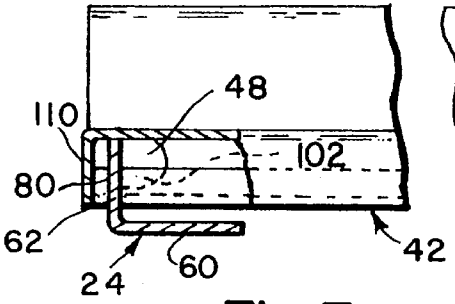
FIG. 7 is a fragmentary cross-sectional view of the shelf and bracket subassembly taken along the section line 7—7 in FIG. 6.
Figure 8:
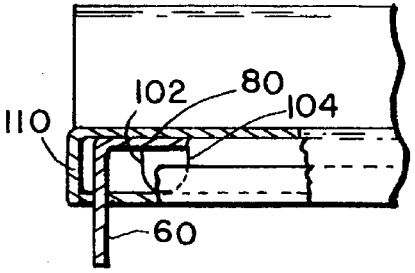
FIG. 8 is a fragmentary cross-sectional view similar the left side portion of FIG. 7 but showing the bracket in the operative position.

In FIGS. 6, 7, 7A, and 8 the manner in which the brackets are allowed to slide and pivot with respect the shelf is clearly illustrated. In FIGS. 6 and 7, the bracket 24 is shown in the stored or inoperative position. The extensions 80 and 82 are held between the lower surface 32 of the shelf 17 and the upper edges 114 of the flanges 44 and 56 of the tracks 42 and 52. The side edges 102 of the tabs do not rest on the bottoms of the channels. The main body 60 of the bracket is disposed in a plane just beneath the bottoms of the tracks.

It will be noted in FIG. 6 that the rear portion 64 of the bracket extends beyond the track 52. To move the bracket 24 to the operative position wherein it may be attached to the standard 12 so as to support the shelf, it is only necessary to pull down upon the main body 60 so as to cause the bracket to pivot about the top edges 114 of the flanges of the tracks so that the rounded portions of the tabs engage the bottoms of the channels 46 and 54. This is suggested by the full and broken line showing of the bracket 22 in FIG. 7A. In the erect position, the horizontal flange 62 of the bracket lies against the lower surface 32 of the shelf 17 and the frictional engagement of the flange with the bottom of the shelf and the tabs in the tracks yieldably retains the bracket in the operative position.

From the foregoing description, it will be apparent how the embodiment shown and described accomplishes the objects set forth in the introduction. The brackets are freely slidable along the full length of the shelf in the front and rear tracks 42 and 52 of the shelf so as to place them in the proper position to engage the standards 10 and 12 on which the shelf is to be supported. When the shelf is stored, boxed or otherwise packaged for shipment, the brackets 22 and 24 may be pivoted to the stored position wherein the main body of each bracket lies parallel to the shelf. This minimizes the effective thickness of the shelf and bracket subassembly so as to minimize the space required for each. It is to be understood that while in the illustrated embodiment but two brackets are shown secured to the shelf, additional brackets may be secured to the shelf as well. For example, in 48 inch shelves, three brackets may be carried by each shelf when the shelf is to be supported on standards that are conventionally spaced 24 inches apart. In that event, two of the brackets would be moved to the operative position at the respective ends of the shelf while the third bracket would be disposed at the middle of the shelf. The position of each bracket may be varied while in the operative position by sliding them longitudinally on the shelf so as to cause registration of the ears 66 and 68 with the slots 70 in the standards.

Because the brackets are not removable from the shelf, they will not be lost or misplaced when a shelf and bracket subassembly stored. Thus, the present invention affords maximum adjustability of the brackets with respect to the shelf and at the same time maintains the subassembly intact and ready for use when needed.

Having described this invention in detail, those skilled in the art will appreciate that numerous modifications may be made thereof without departing from its spirit. Therefore, it is not intended that the scope of this invention be limited to the specific embodiment illustrated and described. Rather, the breadth of the invention is to be determined by the appended claims and their equivalents.

What is claimed is:

1. A shelf and supporting brackets combination to be mounted on a pair of vertical standards having slots thereon for receiving a back end portion of the brackets, the shelf and supporting brackets combination comprising:

a shelf including top and bottom surfaces, front and back edges and front and back flanges extending downwardly from the front and back edges the shelf having a front channel and a back channel respectively disposed lengthwise on the front and back flanges; and at least two supporting brackets adjustably connected to the shelf in spaced relation to each other, each supporting bracket including a front tab and a back tab respectively secured to a front end and a back end of the supporting bracket, the front and back tabs being slidably captured in the front and back channels so that each supporting bracket can be slid lengthwise along the shelf to adjust the spacing therebetween, the supporting brackets being constructed and arranged to be selectively retained on the shelf in a supporting position and a stored position, the supporting brackets being generally perpendicular to the shelf in the supporting position and substantially parallel to the shelf in the stored position.

2. The shelf and supporting brackets combination as defined in claim, wherein each supporting bracket includes a main body portion and a top flange, the top flange having ends, the main body portion being perpendicular to the shelf and the top flange lying parallel to and immediately adjacent the shelf when the bracket is in the supporting position, the front and back tabs being connected to the top flange and being spaced beyond the ends thereof.

3. The shelf and supporting brackets combination as defined in claim 1, wherein the front and back channels open upwardly and are spaced below the bottom surface of the shelf, and the front mad back tabs extend downwardly from the front and back ends of the supporting brackets into the front and back channels.

4. The shelf and supporting bracket combination as defined in claim 1, wherein the supporting brackets are pivotally connected to the shelf.

5. The shelf and supporting bracket combination as defined in claim 4, wherein each bracket can pivot along an axis transverse to the length of the shelf.

6. The shelf and supporting bracket combination as defined in claim 1, wherein the front and back tabs each includes an arcuate lower edge.

7. The shelf and supporting bracket combination as defined in claim 6, wherein the lower edge is semicircular.

8. A shelf system comprising a plurality of vertically extending standards, a shelf and multi-bracket subassembly wherein the brackets are permanently and slidably retained on the shelf, so as to enable the brackets to be connected of the standards and accommodate different spacings of the standards, and a connecting means joining the brackets to the shelf enabling the brackets to be collapsed flat against the shelf when the shelf and brackets are not in use.

9. The shelf system as defined in claim 8, wherein the brackets are pivotally retained to the shelf.

10. A shelf system as defined in claim 8, wherein the shelf has a pair of parallel tracks that extend a substantial portion of the shelf length and the brackets having slides that engage the tracks enabling the brackets to move toward and away from one another to accommodate the spacing of the standards.

11. The shelf system as defined in claim 10, wherein each bracket can pivot within the tracks between an operative position and an inoperative position.

12. The shelf as defined in claim 11, wherein each slide includes an arcuate lower edge.

13. The shelf as defined in claim 12, wherein the lower edge is semicircular.

14. A shelf and supporting bracket combination comprising:

a shelf having top and bottom surfaces and front an back edges, the shelf including front and back tracks respectively disposed parallel to the front and back edges thereof; and a bracket disposed beneath the bottom surface of the shelf, the bracket having front and back ends and including front and back tabs disposed adjacent the front and back ends, the front and back tabs being retained to the front and back tracks to prevent the bracket from being separated from the shelf, wherein the bracket can be moved lengthwise along the shelf and can be pivoted on the shelf between an operative position and an inoperative position.

15. The shelf and supporting bracket combination ad defined in claim 14, wherein the bracket can be slid along the length of the shelf.

16. The shelf and supporting bracket combination as defined in claim 14, wherein each of the front and back tabs includes an arcuate lower edge.

17. The shelf and supporting bracket combination as defined in claim 16, wherein the lower edge is semicircular.

18. The shelf and supporting combination as defined in claim 14, wherein the bracket includes a main body and an upper flange attached to the main body, the upper flange being perpendicular to the main body.

19. The shelf and supporting bracket combination as defined in claim 18, wherein the front and back tabs are disposed on opposing ends of the upper flange.

20. The shelf and supporting bracket combination as defined in claim 19, wherein the front and back tabs extend downdwardly from the upper flange.

21. The shelf and supporting bracket combination as defined in claim 18, wherein the main body of the bracket is generally perpendicular to the bottom surface of the shelf in the operative position and generally parallel to the bottom surface of the shelf in the inoperative position.

22. The shelf supporting bracket combination as defined in claim 14, wherein the shelf includes a front panel and an back panel extending downwardly from the front and back edges respectively, the front and back tracks being disposed on an inner face of the front and back panels.

23. The shelf and supporting bracket combination as defined in claim 14, wherein the shelf includes opposing end flanges disposed adjacent opposing ends of the front and back tracks, the end flanges being constructed and arranged to retain the front and back tabs to the front and back tracks.

24. A shelf assembly to be mounted on a support structure having a mounting spacing, the shelf assembly comprising:

a shelf; and a pair of brackets retained to the shelf, the brackets being constructed and arranged to be mounted on the support structure, each bracket being pivotally attached to the shelf and at least one bracket being slidably attached to the shelf, wherein the brackets can be pivoted between a supporting position and a stored position, and the at least one bracket can be slid lengthwise along the shelf to accommodate the mounting spacing of the support structure.

25. The shelf assembly as defined in claim 24, wherein the shelf includes a pair of parallel tracks disposed along a substantial portion of the shelf and the at least one bracket includes a pair of tabs that engage the tracks so that the at least one bracket can be slid toward and away from the other of the pair of brackets.

26. The shelf assembly as defined in claim 25, wherein each tab includes an arcuate lower edge.

* * * * *